US005110118A

United States Patent [19]

Winey

[11] Patent Number: 5,110,118

[45] Date of Patent: May 5, 1992

[54] RESISTANCE MECHANISM FOR EXERCISE EQUIPMENT

[76] Inventor: Timothy Winey, 2514 Fair Oaks Blvd. #200, Sacramento, Calif. 95825

[21] Appl. No.: 539,350

[22] Filed: Jun. 18, 1990

[51] Int. Cl.[5] ..... A63B 21/00

[52] U.S. Cl. ..... 482/73; 482/113

[58] Field of Search ..... 272/72, 73, 130, 131, 272/132, 69, 97

[56] References Cited

U.S. PATENT DOCUMENTS 2,725,231 11/1955 Hoover ..... 272/72
3,495,824 2/1970 Cuinier ..... 272/130
3,572,700 3/1971 Mastropaolo ..... 272/130
4,579,335 4/1986 Centatanti ..... 272/93
4,582,318 4/1986 Giannelli et al. ..... 272/130
4,979,735 12/1990 Stewart ..... 272/130

*Primary Examiner*—Stephen R. Crow
*Attorney, Agent, or Firm*—Bielen, Peterson & Lampe

[57] ABSTRACT

A resistance mechanism for exercising equipment that includes a frame structure on which is mounted a positive-displacement rotary pump, the pump having a housing with a rotor that pumps fluid through a closed circuit which includes a reservoir and conduit leading to the pump and conduit leading from the pump to the reservoir. The pump rotor is connected to an actuator for rotating the rotor and pumping fluid through the circuit with the circuit having a valve to constrict the conduit leading from the pump to vary the force required to pump fluid through the closed circuit.

7 Claims, 4 Drawing Sheets

RESISTANCE MECHANISM FOR EXERCISE EQUIPMENT

BACKGROUND OF THE INVENTION

This invention relates to exercise equipment and in particular to a resistance mechanism for exercise equipment that develops a unique response to actuation by the user. The resistance mechanism can be installed in a variety of different types of exercise equipment to provide a dynamic resistance that is particularly useful for sports enthusiasts who utilize exercise equipment to assist in the performance of athletic competition where speed and agility, as well as strength, are critical factors.

The recent growth in a health conscious society has generated athletic clubs that are enjoyed not only by the athletically inclined, but by ordinary individuals who wish to maintain or improve their physical well being. The new generation health club has an extraordinary variety of exercise equipment, which not only selectively exercises particular muscle structures, but does so in a generally interesting and safe manner. The recent combination of electronics with mechanics has enabled the stationary exercise equipment of the health studio to simulate the cross county bicycle race or mountain climb. Exercise at a modern health club has become an enjoyable as well as wholesome activity.

Yesterday's exercise room, which customarily only included free weights and a limited assortment of pulley connected weights, has been transformed to a modern mirror-walled facility having a cornucopia of every conceivable construction of cams, pulleys, levers, sprockets, chains, weights, and pistons, arranged into every contrivance imaginable. However, the devices constructed almost invariably are designed with the object of providing a constant or near constant resisting force over a limited linear or arcuate distance regardless of the speed of actuation. Where weights are employed, even this design objective is generally not achievable as the inertial effect of the weights enables the user to "cheat" in his exercise by swinging motions aided by the body. To control this effect, an exercise using weights, either free or connected by pulleys or cams, must be performed at a slow and steady pace. Frequently, however, the muscles that are developed are utilized in sports activities and real life endeavors in a dynamic manner that has little relationship to the motion pattern of the exercise regime. This anomaly applies to much of the equipment that attempts to duplicate its real like counterpart including rowing machines and cycles.

The primary object of the present invention is to introduce a new type of dynamic resistance mechanism that can be incorporated into exercise equipment and provide a resistance that increases upon increase in the velocity of the actuator mechanism. The actuator mechanism can be of any typical means such as a bar, hand grip, pedal, lever or other customary member positioned with respect to the user to trace a select motion to develop a particular muscle structure. The resistance mechanism in its basic configuration can operate with actuated linear or rotary motion. In a more complex structure, the resistance mechanism can operate with any planar motion and can therefore form the cornerstone of a variety of different embodiments of exercise equipment.

SUMMARY OF THE INVENTION

The resistance mechanism for exercise equipment of this invention comprises a positive displacement, fluid pump having an actuator mechanism and a control valve for regulating the flow of fluid in a closed circuit. The actuator mechanism can be of any conventional type, and as shown in the preferred exemplar embodiments, comprises a first structure for developing simple linear motion and a second structure for developing more complex two dimensional motion. In both exemplars, the positive displacement pump system provides a resistance that varies in direct proportion to the velocity of the input motion such that the more rapid is the repetitive input movement of the user, the greater is the force of resistance that is encountered by the user.

In the first exemplar for linear motion, a rowing-type structure is employed with a horizontal frame having a seat and a pair of foot rests enabling a user to sit with his legs extended and positioned on the foot rests. Between his feet is drawn a chain or cable having at one distal end a hand grip that is grasped by the user and drawn toward his abdomen during exercise routines. The chain rides over a sprocket connected to the rotor shaft of a rotary, positive-displacement pump. The chain returns toward and under the seated user, carried within a central conduit member forming part of the horizontal frame, where it connects to a tension spring that provides a return force without substantially interfering with the dynamic resistance force resulting from the pulling action of the user.

The rotary pump includes a closed circuit fluid passage which returns pumped fluid from a pump chamber to a reservoir in the pump. The fluid passage includes a valve means for constricting the passage to enable adjustment of the resistance to fluid flow. As a visual feed-back feature, the passage preferably includes a communicating pressure indicator which in its simplest form comprises a pressure gauge. In more sophisticated electronically enhanced devices, this visual feed-back feature can be embodied in a computer screen display where the sensed pressure is transduced to a visual graphical image or visual animation such as a rowing contest, a cycling enduro or other display sequence that enhances the exercise experience by a feedback stimulus.

For an actuation motion that is more complex than linear or angular, a two dimensional resistance mechanism has been devised which utilizes a multi-direction planar carriage system, with a bi-directionally moving carriage in a frame with two positive displacement pumps that integrate motion resistance on two perpendicular axes to provide a summed resistance that is independent of the direction of motion in the defined plane, but is dependent on the adjusted flow constriction of the fluid through the pumps, and uniquely, is again dependent on the velocity of the actuating motion.

In the exemplar structure of this embodiment, a multipurpose exercise device is described in which the same structure is used for several different exercise regimes. The multipurpose device disclosed has a sit-down, horizontal bench with a vertical chest-pad with a pair of padded elbow supports and a pair of horizontally disposed, interconnected hand grips. The hand grips are connected to a moveable carriage in a square frame. The frame is perpendicularly disposed such that the outstretched arms of a user are positioned on each side of the frame when gripping the hand grips.

The multidirectional planar carriage system is a conventional dual carriage structure with a first slidable carriage mounted on proximal dual parallel guides arranged in a first direction that have distal end supports which mount on guides such that the first carriage and guide assembly form a second carriage slidably mounted on distal parallel guides arranged in a second direction perpendicular to the first direction.

The dual carriage system is commonly used in graphical plotters and other devices where planar motion in any direction is desired. The first carriage has a looped drive chain with a selective detent mechanism to selectively engage the carriage with the drive chain depending on the direction of displacement of the carriage. The drive chain is connected to a sprocket on the rotor of a first positive displacement pump carried by the carriage assembly. The second carriage comprises the first carriage and guide assembly and has a drive chain which is connected to a sprocket on the rotor of a second positive displacement pump mounted on the frame. The two looped chains are perpendicular to one another to allow actuation of one or the other or both of the pumps depending on the direction of motion of the first carriage. The detent mechanisms are designed to insure that the pump rotor is rotated in a consistent angular direction. With appropriate one-way valving or a more sophisticated bi-directional positive displacement pump, the detent mechanism could be avoided.

Suitable actuating mechanisms are connected to the first carriage to achieve the exercise regime desired. Additionally, a pair of dual carriage frames can be arranged on each side of an exercise station to allow for a straight horizontal or bent bar to interconnect the two opposed first carriages to provide for a structure similar to common bar-type exercises but with a different dynamic resistance that varies with velocity of the actuating motion. Such a system would utilize four rotary positive displacement pumps.

It is to be understood that the preferred embodiments of the resistance mechanism disclosed herein are incorporated in exercise devices that are shown as typical environments for the novel resistance mechanism claimed and are not intended to limit the scope or application of the mechanism to other exercise structures.

Furthermore, while the resistance mechanism is ideally adapted to exercise equipment for muscle development, the mechanism can be incorporated into medical diagnostic equipment and therapeutic equipment with advantage. In such environment, the same equipment can be used both diagnose and measure the progress of a patent's physical condition or development, and, to comprise the means of such physical development.

DETAILED DESCRIPTION OF THE PREFERRED EMBODIMENTS

Figure 1:
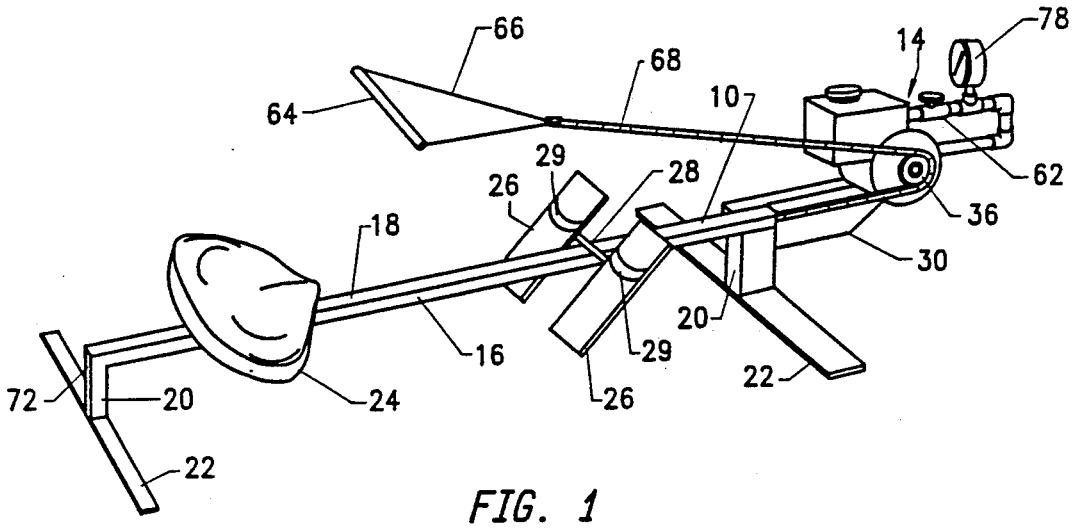
FIG. 1 is a perspective view of a rowing machine having the resistance mechanism of this invention.
Figure 2:
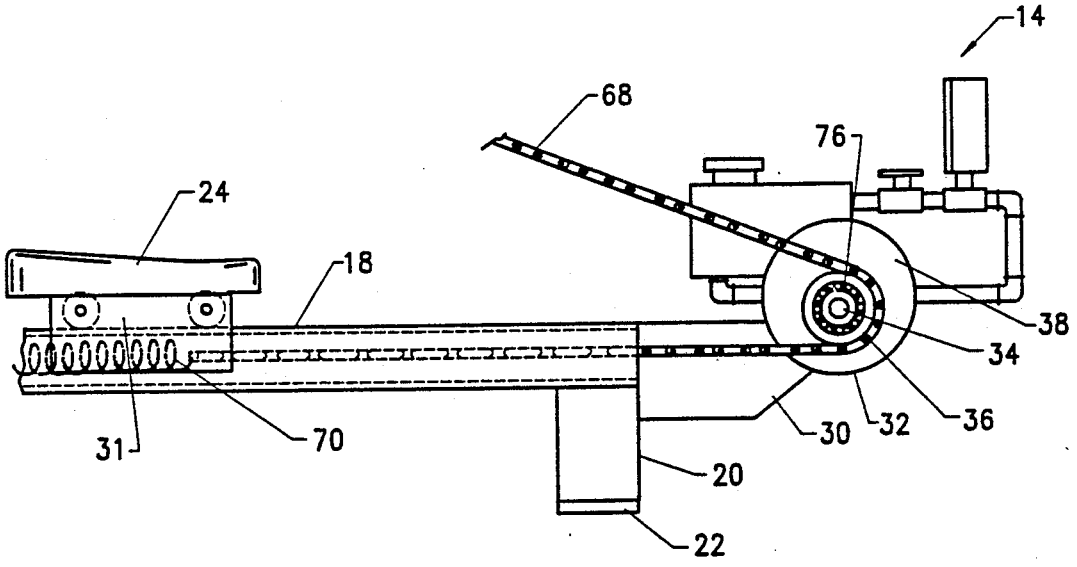
FIG. 2 an enlarged view partially in cross section of the device of FIG. 1.
Figure 4:
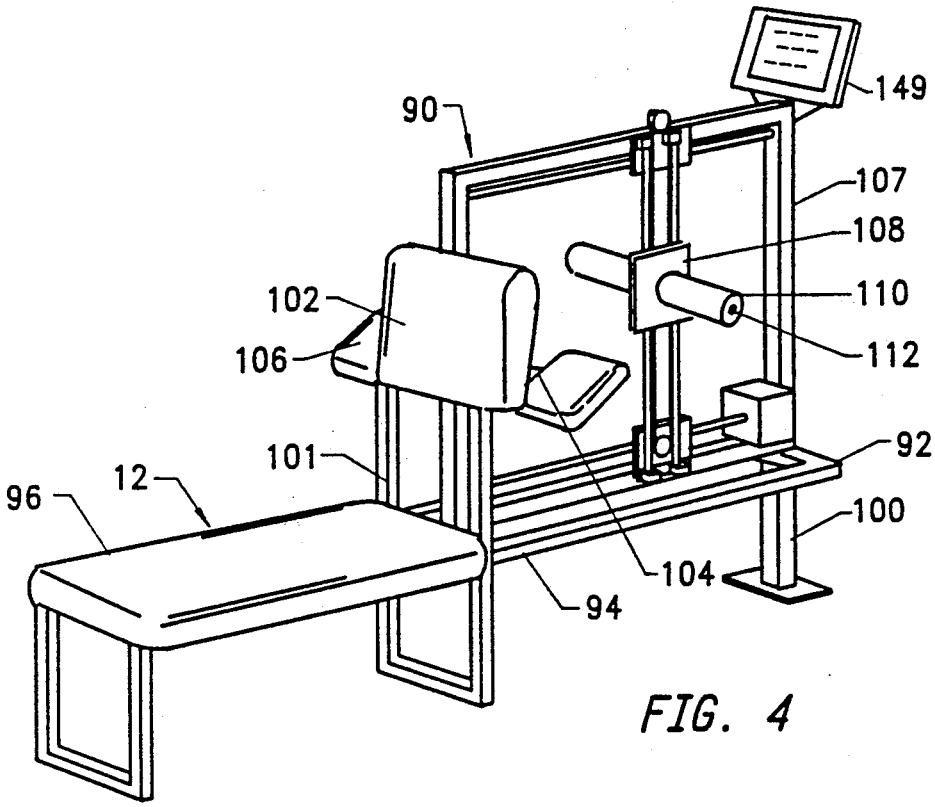
FIG. 4 is a perspective view of an arm exercise mechanism having an alternate embodiment of the resistance mechanism.
Figure 3:
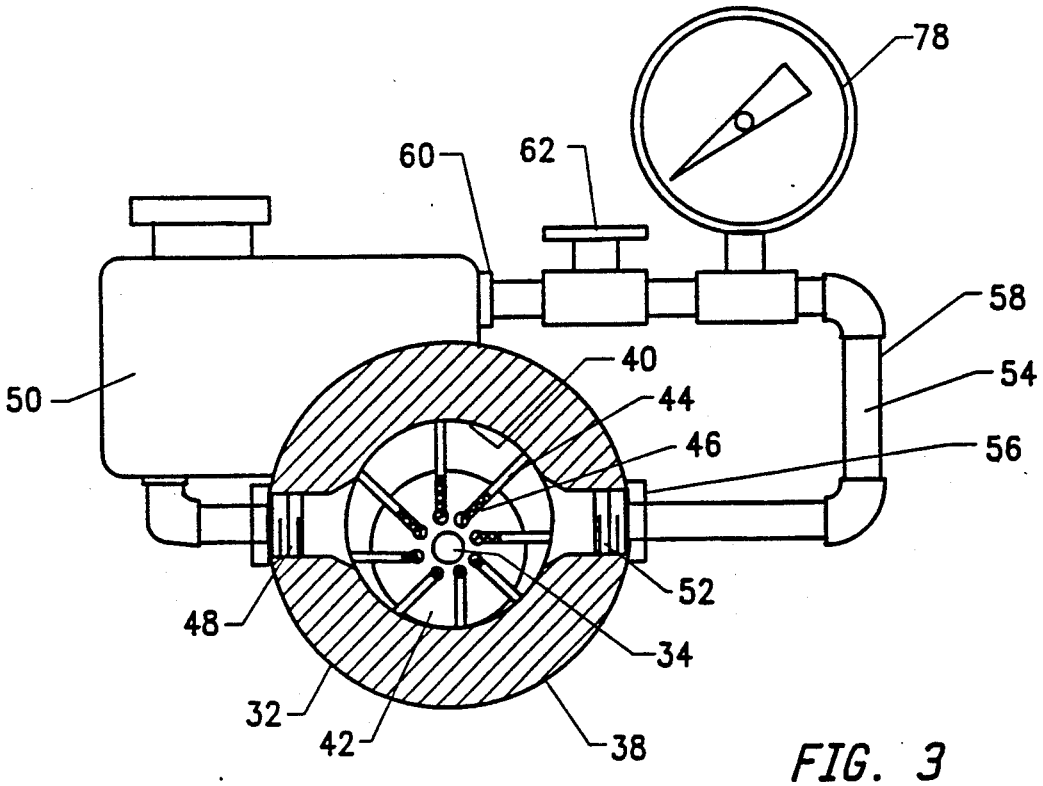
FIG. 3 is a schematic view of the resistance mechanism utilized in the exercise equipment.
Figure 5:
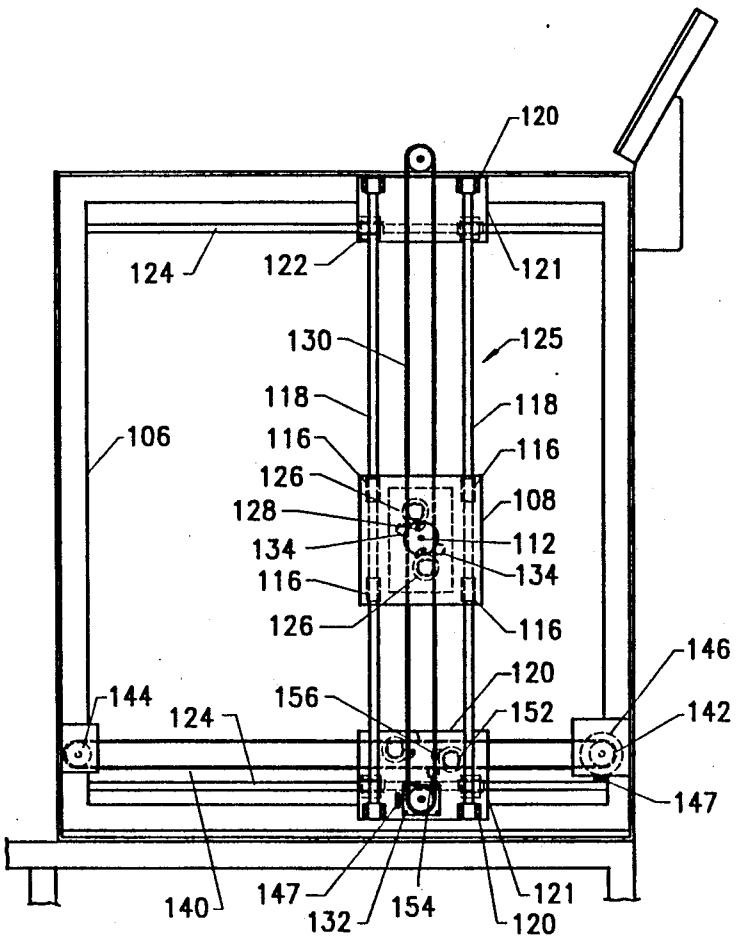
FIG. 5 is a partial side elevation view of the resistance mechanism used in the alternate embodiment of FIG. 4.
Figure 6:
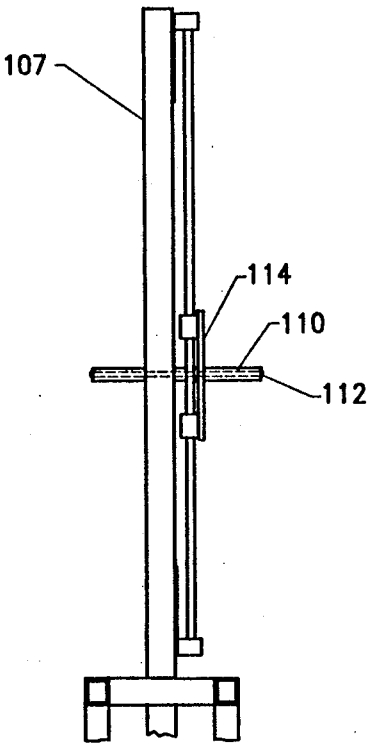
FIG. 6 is an end elevational view of the mechanism of FIG. 5.
Figure 7:
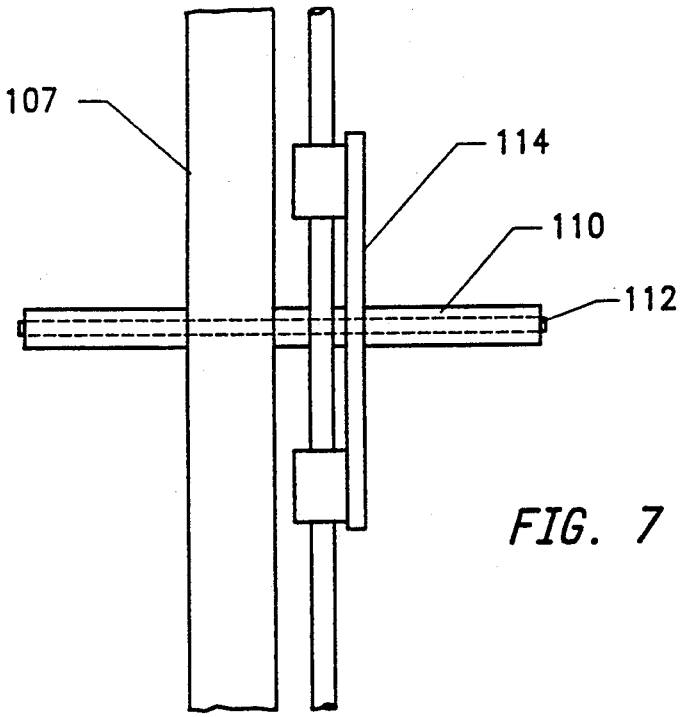
FIG. 7 is an enlarged partial view of the carriage assembly of the resistance mechanism of FIG. 4.
Figure 8:
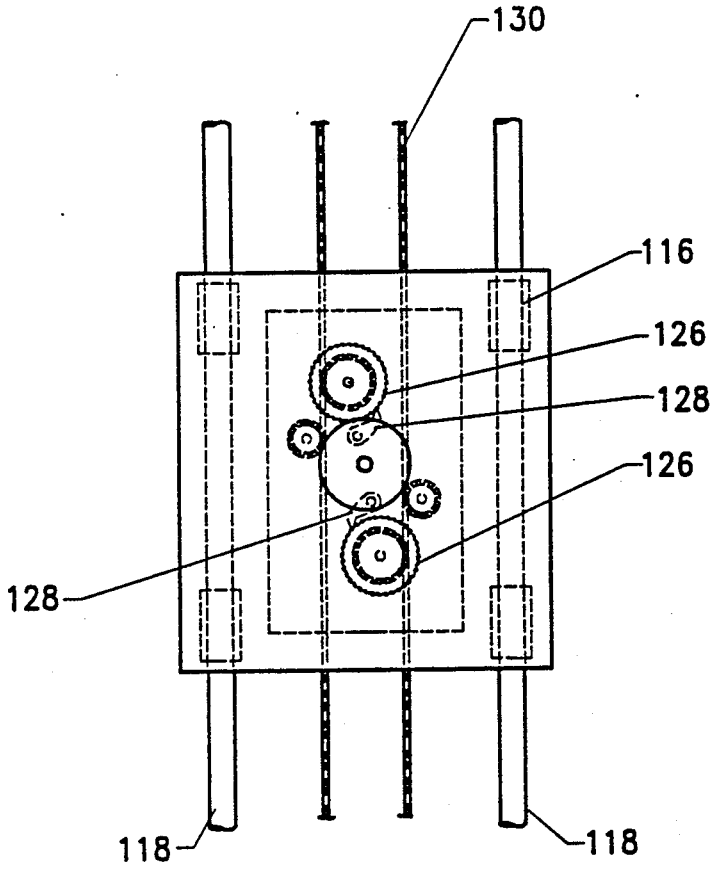
FIG. 8 is an enlarged partial side view of the carriage assembly of the resistance mechanism of FIG. 4.

The resistance mechanism for exercise equipment of this invention is shown installed on two examples of typical equipment in which it is usable. The embodiment of FIGS. 1–3 illustrates the incorporation of the resistance mechanism in a simple rowing machine device designated generally by the reference numeral 10. A more complicated assembly of the resistance mechanism, to enable variable exercise motion, is shown in FIGS. 4–8 in a sit-down, arm exercise device, designated generally by the reference numeral 12. These two examples illustrate the varieties of types of equipment into which the mechanism can be installed with the same dynamic effect.

Referring now to FIG. 1, the resistance mechanism, which is designated by the reference numeral 14 is mounted at the end of a structural frame 16 of the rowing machine device 10. The structural frame 16 has an elongated horizontal member 18 made of square tube that is supported at each end by post member 20 and foot member 22. Proximate one end of the horizontal member 18 is a seat 24, and displaced from the seat 24 are two foot rests 26 mounted on each side of the horizontal member 18 by a brace 28. The foot rests 26 have straps 29 to retain the user's feet on the rests during exercising. The seat 24 has a roller guide 31 to enable the seat 24 to freely slide or the horizontal member 18 to simulate the action of a racing skull.

The resistance mechanism 14 is connected to a mounting bracket 30 at the end of the horizontal member 18 opposite the seat 24. The resistance mechanism 14, as also shown in FIG. 2 and 3 includes a positive displacement fluid pump 32 having a rotor axle 34 with a chain sprocket 36 mount thereon. The fluid pump includes a housing 38, which is shown in the schematic view of FIG. 3' and houses an internal pump chamber 40 with a rotor 42 having a series of vanes 44 that are biased by compression springs 46 to maintain the end of the vanes 44 against the wall of the pump chamber 40 which is eccentric to the axis of rotation to the rotor 42. In this manner, as the rotor rotates fluid that enters the chamber inlet 48 from a fluid reservoir 50 is pumped to an outlet 52 which is connected in a closed circuit to the reservoir 50 by a fluid passage 54. The fluid passage 54 is formed by an outlet fitting 56 that connects a conduit 58 to a reservoir fitting 60 to return fluid that has been pumped through the pump chamber 40 through the return conduit 58 to the reservoir 50. To vary the resistance of passing fluid through fluid passage 54 a valve 62 is connected in line on the conduit 58 to provide a constriction to the fluid passage. The valve 62 can be varied according to the desire of the equipment user during operation of the exercise equipment.

In the embodiment of a rowing machine 10, the user sits on the seat 24 with his legs outstretched and his feet placed on the foot rests 26 with his arms grasping a towing bar 64 that has a bifurcated cable 66 that is connected to a chain 68. The chain 68 wraps around the chain sprocket 36 and connects to the end of a tension spring 70 that is contained within the hollow horizontal member 18 and anchored at its opposite end to an end cap 72. The tension spring 70 permits the chain to be retracted into the horizontal member 18 after the stroke of the user is relaxed. To simplify the implementation of the resistance mechanism into the exercise equipment, the positive displacement pump 32 is designed to be rotated in a single direction. In order to allow the return of the towing bar 64 the chain sprocket 36 is mounted on a free wheel hub 74 that has a roller and a cam assembly 76 to permit rotation and engagement of the pump rotor 42 in only one direction.

During the exercise regime the user can adjust the valve 62 to provide the range of resistance that is desired. As the resistance is dependent on the rate of rotation of the rotary pump, the more rapidly the tow bar is pulled, the greater will be the resistance encountered. In order to provide a means of visually monitoring the level of resistance, a monitoring device, such as the pressure gauge 78 shown in FIG. 1 and 3 is mounted on the conduit 58 between the pump outlets 52 and the valve 62. Other means such as an electronic sensor can be utilize to give an analog signal that can be use as an input to an electronic device to provide more elaborate visual feed back information.

Referring now to FIGS. 4–8, an alternate embodiment of the resistance mechanism is shown and designated by the reference numeral 90. The resistance mechanism 90 comprises a component of an arm exercise device 12. The arm exercise device 12 includes a structural frame 92, having elongated horizontal members 94 which support the resistance mechanism 90 and a padded bench 96. The horizontal members 94 are supported at one end by a square tube leg 98 and at the other end by a pedestal 100. In the center, a square tube assembly 101 connects to the horizontal member 94 of the bench 96 and supports a chest pad 102. A cross brace 104 provides support for two elbow pads 106 to permit the arm exercise device to be utilized as a biceps, curl machine. The resistance mechanism 90 is constructed with a rectangular frame 107 that supports a bi-directionally moveable, carriage assembly 108 on which are mount two hand grips 110 rotatably mounted on a cross shaft 112.

As shown in greater detail in FIGS. 5–8, the carriage assembly 108 includes a mounting plate 114 with guide bearings 116 that engage a pair of proximately spaced elongated cylindrical guides 118. The carriage assembly 108 slides upon the proximately spaced guides 118, which have end guide blocks 120 at their ends. The guide blocks 120 are mounted on plates 121 having guide bearings 122 on the backside of the plates 114 which engage distally spaced cylindrical guides 124. The carriage assembly 108, guides 118 and guide blocks 120 in combination comprise a second carriage assembly 125 that is slidable on the spaced stationary guides 124. This construction allows the first carriage assembly 108 to be moveable in any direction with in the plan of the frame 106.

The support plate 114 of the first carriage assembly 108 includes a pair of sprockets 126 having detents 128 which engage a ratchet surface to permit the sprockets to rotate in a single direction only. In this manner as the carriage assembly 108 tracks on the guides 118, one or the other of the sprockets 126 will be inhibited from rotating and lock the support plate 114 to the continuous tracking chain 13 resulting in rotation of the positive- displacement fluid pump 132 in one angular direction only. For example, if the carriage assembly 108 reverses direction one of the two sprockets 126 will become an idler gear and the other sprocket will be lock to the chain by its detent 128 causing the tracking chain 130 to rotate the pump 132 in the functional angular direction with, the small idler rollers 134 maintaining the chain against the sprockets 126. The fluid pump 132 includes the closed circuit fluid system described with reference to FIG. 3.

Similarly, the second carriage assembly 125 that is made up of the guides 118, the guide blocks 120 and end plates of the first carriage assembly 108, traverses in the perpendicular direction to the first assembly on guides 124. A second tracking chain 140 activates a second positive-displacement fluid pump 142 as the second assembly moves. The tracking chain 140 engages an idler sprocket 144 mounted on the frame and also connects to a sprocket 146 on the fluid pump 142. The fluid pumps have regulating valves 147 to adjust the resistance of each pump as desired. Generally the settings of the valves will be adjusted to be the same for each pump to create a uniform resistance force for any direction of motion at a given rate of movement. More complex resistance patterns can be devised by dissimilar settings of the valve means if desired. An electronic display 149 is electrically connected to sensors (not shown) that monitor the pressure of fluid pumped by the pumps. In more sophisticated embodiments, where the resistance mechanism is used as diagnostic test equipment, more elaborate measurements can be compiled and graphed over a time span. Use of the resistance mechanism in medical equipment for both physical training and analysis of physiological response is warranted because of the aerobic nature of the exercise and the ability to quantitatively record the parameter of the exercise routine.

In order to insure that the pump 142 is rotated in a single angular direction, a detent and sprocket mechanism 148 is employed that is similar to the mechanism for the first carriage assembly 108. The sprocket mechanism 148 is mounted on one of the end plates 121 and includes sprockets 152, idler rollers 154 and detents 156. The two transport plates 121 are coupled by the guide rods 118 for the first carriage and move as a unit on guides 124 perpendicular to the travel of the first carriage 108. Depending on the direction of travel, one or the other sprocket on the transport plate 121 is locked to the chain 140 causing select rotation of the pump 142. Reversal of direction will lock the other sprocket to the chain resulting in the same select rotation of the pump.

In operation, the compound displacement of the first carriage assembly in one direction and the second carriage in a perpendicular direction results in a bi-directional movement at the first carriage assembly.

By mounting the actuator means on the first carriage assembly, here the hand grips 110, the actuation motion can be directed in any direction in the plane of the frame. The resistance to motion is the compound effect of the two pumps, one assuming the displacement vector in the x-direction and the other assuming the displacement vector in the y-direction. In summation, an effective resistance is developed that is proportional to the rate of motion regardless of the direction of movement.

Thus, the exercise device of FIGS. 4–8 enables arm curls to be performed with immediate adjustment for the length of the user's arm, push-pull exercises to be accomplished with immediate positioning of the user's arms relative to his/her seated height, and circular rowing motions to be performed with the user having control over the radius of the motion circle desired. Other exercises will become apparent to user's of this versatile arm exercise equipment.

It will be understood that the principle of the resistance mechanism can be applied to exercise equipment of different design and operation. However, the essential resistance characteristics will be retained to provide a new dynamic action for the exercise regime. Furthermore, while the embodiments described above were constructed using readily available mechanical and hydraulic components and incorporated a simple General Motors hydraulic steering fluid pump as the positive displacement pump, a production system will be expected to include more integrated and efficient components to generate the actuation response devised. The auxiliary components used to measure, record and display the levels and duration of the resistance action, and to automatically regulate the resistance levels, are supplementary to the basic concepts here defined and are considered add-ons for developing interesting exercise equipment or useful medical equipment.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A resistance mechanism for exercising equipment comprising:

an elongated frame structure having a first end and a second end;

a positive displacement fluid pump mounted at the first end of the frame structure, the pump having a rotor shaft a fluid passage from the reservoir to the inlet of the pumping chamber, a fluid passage from the outlet of the pumping chamber to the reservoir and indicator means for gauging the level of resistance of the resistance mechanism;

actuator means for actuating the pump and forcing fluid through the fluid passage from the pumping chamber to the reservoir, said actuator means including a manual input means for an exerciser to exert a dynamic input force on the actuator means displacing the actuator means to operate the pump; and, regulating means for regulating the flow of fluid through the fluid passage from the pumping chamber to the reservoir, wherein the resistance mechanism is constructed and arranged to increase the level of resistance to a physical input according to the rate of displacement of the actuator means, wherein the frame structure includes a horizontal central member with a seat positioned thereon facing the pump and displaceable in part between the first end and the second end of the frame structure, wherein the pump rotor shaft includes a sprocket and the actuator means comprises a hand grip tow bar connected to an elongated chain that engages the sprocket, the chain being wrapped around the sprocket at the first end of the frame structure and connected to an elongated tension spring anchored at the second end of the frame structure.

2. The resistance mechanism of claim 1 wherein the indicator means is a pressure responsive visual indicator connected to the fluid passage from the pumping chamber positioned between the pumping chamber and the regulating means.

3. The resistance mechanism of claim 1 wherein said positive displacement pump is a rotary vane pump.

4. The resistance mechanism of claim 3 wherein the rotary vane pump has a rotor and said actuator means includes a mechanism to rotate the rotor that is connected to the manual input means wherein displacements of the actuator means rotates to pump rotor.

5. The resistance mechanism of claim 1 wherein the regulator means comprises a valve located on the fluid passage between the outlet of the chamber and through reservoir.

6. The resistance mechanism of claim 5 said indicator means communicating with the liquid passage between the outlet of the chamber and the regulator means.

7. The resistance mechanism of claim 1 wherein the horizontal central member of the frame structure is tubular in construction and the elongated tension spring and a portion of the chain, where connected to the tension spring, are contained within the frame structure.

* * * * *